US008303170B2

(12) United States Patent
Fujieda

(10) Patent No.: US 8,303,170 B2
(45) Date of Patent: Nov. 6, 2012

(54) BEARING STRUCTURE AND WATCH EQUIPPED WITH THE SAME

(75) Inventor: Hisashi Fujieda, Chiba (JP)

(73) Assignee: Seiko Instruments Inc. (JP)

( * ) Notice: Subject to any disclaimer, the term of this patent is extended or adjusted under 35 U.S.C. 154(b) by 459 days.

(21) Appl. No.: 12/657,599

(22) Filed: Jan. 22, 2010

(65) Prior Publication Data

US 2010/0188941 A1 Jul. 29, 2010

(30) Foreign Application Priority Data

Jan. 23, 2009 (JP) ..... 2009-012644

(51) Int. Cl.
*G04B 29/00* (2006.01)

(52) U.S. Cl. ..... 368/324; 384/295

(58) Field of Classification Search ..... 368/322–326; 384/295–296

See application file for complete search history.

(56) References Cited

U.S. PATENT DOCUMENTS 884,852 A * 4/1908 Poruba ..... 368/325
1,843,868 A * 2/1932 Copelin ..... 384/246
2,679,440 A * 5/1954 Annen ..... 384/461
2,708,609 A * 5/1955 Triplett ..... 384/222
2,948,573 A * 8/1960 Stamm ..... 384/505
3,077,368 A * 2/1963 Pignone ..... 384/246
3,080,703 A * 3/1963 Body ..... 368/324
2007/0147180 A1 6/2007 Rufenacht et al. ..... 368/184
2007/0159931 A1 7/2007 Rufenacht et al. ..... 368/294

* cited by examiner

*Primary Examiner* — Sean Kayes

(74) *Attorney, Agent, or Firm* — Adams & Wilks

(57) ABSTRACT

The present invention aims to provide a bearing structure allowing direct adjustment between itself and an opposing bearing even after assembly and a watch equipped with the same. A bearing structure of a watch rotatably supports a forward end portion of a shaft of a wheel with respect to a base body, and includes: a bearing, a bearing support body supporting the bearing and having a male screw portion on an outer peripheral surface concentric with the shaft of the wheel, and an adjustment nut equipped with a female screw portion threadedly engaged with the male screw portion of the bearing support body, regulated in its displacement in the extending directions of the shaft of the wheel by the base body, and adapted to adjust the position of the bearing with respect to the extending direction of the shaft via the bearing support body.

19 Claims, 6 Drawing Sheets

BEARING STRUCTURE AND WATCH EQUIPPED WITH THE SAME

BACKGROUND OF THE INVENTION

1. Field of the Invention

The present invention relates to a bearing structure rotatably supporting a forward end portion of a wheel shaft with respect to a base body and, to a watch equipped with the same.

2. Description of the Related Art

Adjustment of the vibration of a balance main body through adjustment of the distance between a balance upper bearing and a balance lower bearing has itself already been proposed (Patent Documents JP-A-2007-178431 and JP-A-2007-178432).

However, in Patent Documents JP-A-2007-178431 and JP-A-2007-178432, in order to adjust the distance between the balance upper bearing and the balance lower bearing, there is effected, at a portion of a balance bridge spaced apart from the balance upper bearing, the adjustment of the distance between the balance bridge and a base body such as a main plate, so that the adjustment is not effected directly; thus, not only is the adjustment rather difficult but also it requires an installation space or an adjustment space. Further, in the case of Patent Document JP-A-2007-178431, there are two adjustment portions, so that the adjustment is so much the more difficult. Further, in this case, it is actually only possible to perform the adjustment on one side.

SUMMARY OF THE INVENTION

It is an aspect of the present invention to provide an object of the present invention to provide a bearing structure allowing direct adjustment of the distance between itself and an opposing bearing even after assembling and a watch equipped with the same.

There is provided, according to the present invention, a bearing structure rotatably supporting a forward end portion of a wheel shaft with respect to a base body, comprising a bearing, a bearing support body supporting the bearing and having a male screw portion on an outer peripheral surface concentric with the wheel shaft, and an adjustment nut equipped with a female screw portion threadedly engaged with the male screw portion of the bearing support body, regulated in its displacement in the extending direction of the wheel shaft by the base body, and adapted to adjust the position of the bearing with respect to the extending direction of the shaft via the bearing support body.

In the bearing structure of the present invention, there are provided "a bearing support body supporting the bearing and having a male screw portion on an outer peripheral surface concentric with the wheel shaft, and an adjustment nut equipped with a female screw portion threadedly engaged with the male screw portion of the bearing support body, regulated in its displacement in the extending direction of the wheel shaft by the base body, and adapted to adjust the position of the bearing with respect to the extending direction of the shaft via the bearing support body," so that, solely by turning the adjustment nut concentric with the wheel shaft, it is possible to displace the bearing itself of the wheel shaft in the extending direction of the shaft via the bearing support body, making it possible to adjust the bearing to an appropriate position, and to adjust the distance between a pair of bearings supporting both ends of the wheel to an appropriate distance, whereby it is possible to appropriately support the rotation of the wheel by the bearing structure.

Here, the female screw portion of the adjustment nut is threadedly engaged with the male screw portion concentric with the wheel shaft, so that the adjustment nut is positioned concentrically with the wheel shaft, whereby it is possible to minimize the requisite space for the arrangement and operation of the adjustment nut. While the bearing and the bearing support body are typically formed as separate components, they may also be, in some cases, formed as an integral unit (inclusive of an identical object) or as components that are normally inseparably fixed to each other.

In the bearing structure of the present invention, the bearing support body is typically biased in one way of the extending direction of the shaft by an elastic member to thereby suppress rattling; however, in some cases, it is also possible to make the screw pitch of the female screw portion of the adjustment nut somewhat different from that of the male screw portion of the bearing support body, thereby suppressing rattling of the bearing support body.

In a typical bearing structure according to the present invention, the bearing support body is fit-engaged with a hole portion of the base body; the bearing support body is equipped with a flange-like portion protruding radially outwards in a region situated on the wheel shaft base portion side of the hole portion of the base body and facing one end surface of a peripheral wall of the hole portion of the base body; between the one end surface of the peripheral wall of the hole portion of the base body and the opposing surface of the flange-like portion of the bearing support body, there is arranged an elastic member exerting a force causing the two surfaces to separate from each other; and one end surface of the adjustment nut is in contact with the end surface of the end surfaces of the peripheral wall of the hole portion of the base body which is on the opposite side of the one end surface.

In this case, under the action of the elastic force of the elastic member, one end surface of the adjustment nut is pressed against the end surface of the end surfaces of the peripheral wall of the hole portion of the base body which is on the opposite side of the end surface facing the elastic member, so that in accordance with rotation in one direction or the opposite direction of the adjustment nut, the bearing support body is displaced in the extending direction of the shaft with respect to the base body, thereby effecting positioning of the bearing in that direction. In the case in which the elastic member is provided, it is possible to absorb impact by the elastic member, thus providing a high impact resistance.

In another typical bearing structure according to the present invention, the bearing support body is fit-engaged with a hole portion of the base body; the bearing support body is equipped with a flange-like portion protruding radially outwards in a region situated on the wheel shaft forward end portion side of the hole portion of the base body and facing one end surface of a peripheral wall of the hole portion of the base body; between the one end surface of the peripheral wall of the hole portion of the base body and the opposing surface of the flange-like portion of the bearing support body, there is arranged an elastic member exerting a force causing the two surfaces to separate from each other; one end surface of the adjustment nut is in contact with the one end surface of the end surfaces of the peripheral wall of the hole portion of the base body; and displacement of the adjustment nut toward the forward end of the shaft is regulated.

In this case, "the elastic member exerts a force to cause one end surface of the peripheral wall of the hole portion of the base body and the opposing surface of the flange-like portion of the bearing support body to separate from each other", and "one end surface of the adjustment nut is in contact therewith, and displacement of the adjustment nut toward the forward end of the shaft is regulated," so that displacement of the adjustment nut in the extending direction of the shaft is actually prohibited, so that, in accordance with the rotation in one direction or in the opposite direction of the adjustment nut, the bearing support body is displaced in the extending direction of the shaft with respect to the base body, thereby effecting positioning of the bearing in that direction.

Typically, in this bearing support structure, the adjustment nut is equipped with a large diameter portion and a small diameter portion, and a protrusion protruding radially inwards from the base body is engaged with a step portion of the large diameter portion and the small diameter portion of the adjustment nut, thereby effecting the above-mentioned regulation.

In this case, the regulation of the displacement of the adjustment nut toward the forward end of the shaft can be effected easily and reliably. Here, as long as it can be held immovably with respect to the base body in the regulating state, the protrusion may be a swaged portion obtained by swaging a part of the base body, a holding ring fitted onto the base body, or some other means of the same effect.

In still another typical bearing structure according to the present invention, the bearing support body is fit-engaged with a hole portion of the base body; the adjustment nut is equipped with a flange-like portion protruding radially inwards; between the nut side end surface of the bearing support body facing the flange-like portion of the adjustment nut and the surface of the flange-like portion facing the nut side end surface, there is arranged an elastic member exerting a force causing the two surfaces to separate from each other; and the adjustment nut is regulated in its displacement in the extending direction of the shaft by the flange-like portion of the base body and a holding ring fitted onto the base body.

In this case, "the elastic member exerts a force causing the nut side end surface of the bearing support body and the surface of the flange-like portion of the adjustment nut facing the same to separate from each other," and "the adjustment nut is regulated in its displacement in the extending direction of the shaft by the flange-like portion of the base body and a holding ring fitted onto the base body," so that, in accordance with the rotation of the adjustment nut in one direction or the opposite direction, the bearing support body is displaced in the extending direction of the shaft, thereby effecting positioning of the bearing in that direction.

Typically, in the bearing structure of the present invention, the adjustment nut has a driver groove in the end surface thereof. However, as long as there is a deformed portion engaged so as to be rotated, it is also possible to provide some other portion (deformed portion) instead of the driver groove.

In this case, the forward end of a screwdriver is fitted into the driver groove to rotate the adjustment nut, so that the adjustment can be effected easily, and the requisite occupation space for adjustment can be substantially minimized.

Typically, in the bearing structure of the present invention, the bearing has a bearing cap jewel and a bearing hole jewel.

In this case, the bearing can rotatably support the shaft with respect to both an axial force and a radial force. It should be noted, however, that the bearing may also be a thrust bearing or a journal bearing rotatably supporting the shaft with respect to solely one of the axial force and the radial force.

Typically, in the bearing structure of the present invention, the wheel consists of a watch component. However, if so desired, it may also be a component of some other machine or apparatus.

Typically, in the bearing structure of the present invention, the wheel consists of a balance with hairspring or an escape wheel & pinion of a watch.

In this case, it is possible to adjust the rotation of the balance with hairspring or the escape wheel & pinion constituting the core of the movement of the watch to an appropriate condition, and the operation of the watch can be easily set to an appropriate condition.

The watch of the present invention is equipped with a bearing structure as described above. While the bearing structure is typically provided solely at one end side of a wheel, if so desired, it may also be provided on either side. In this case, after the assembly, the position in the axial direction of the wheel can be adjusted to an optimum position (in terms of the positional relationship with respect to other wheels).

DESCRIPTION OF THE PREFERRED EMBODIMENTS

Some preferred embodiments of the present invention will be described with reference to the accompanying drawings.

Embodiments

Figure 1:
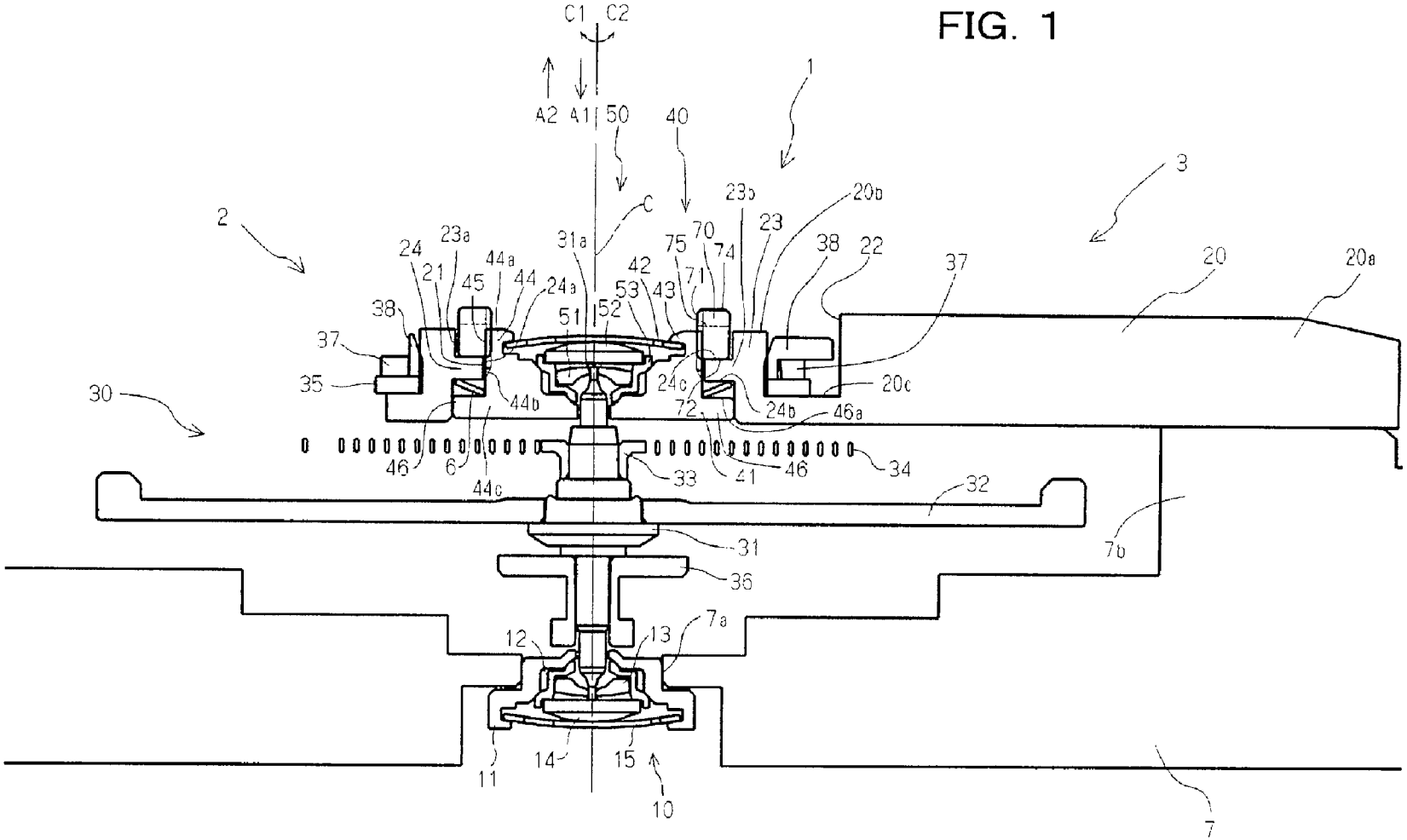
FIG. 1 is an explanatory sectional view of a part of a watch according to a preferred embodiment of the present invention having a balance structure according to a preferred embodiment of the present invention.
Figure 2:
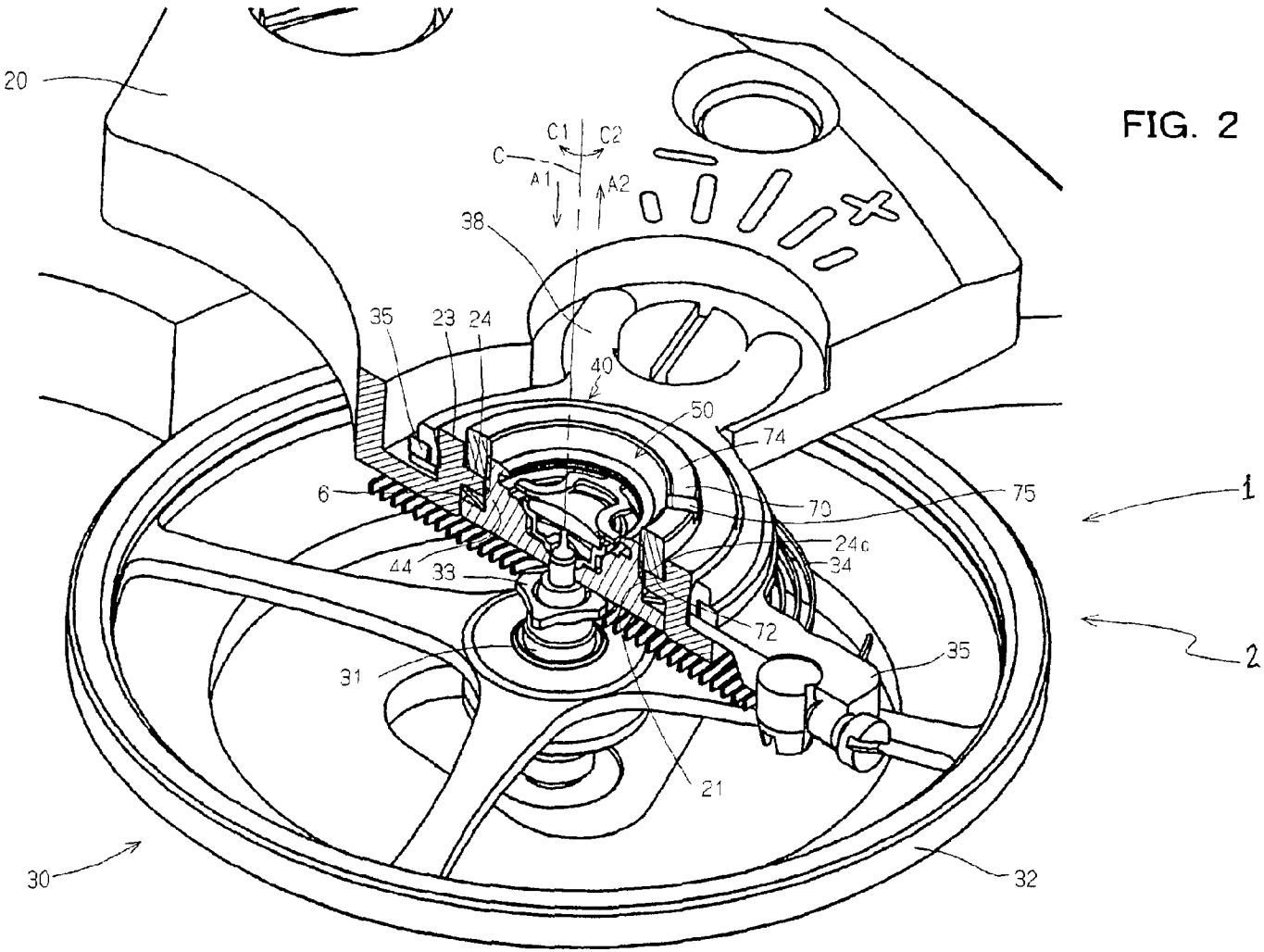
FIG. 2 is a partially cutaway explanatory perspective view of the balance structure portion of the watch of FIG. 1.
Figure 3:
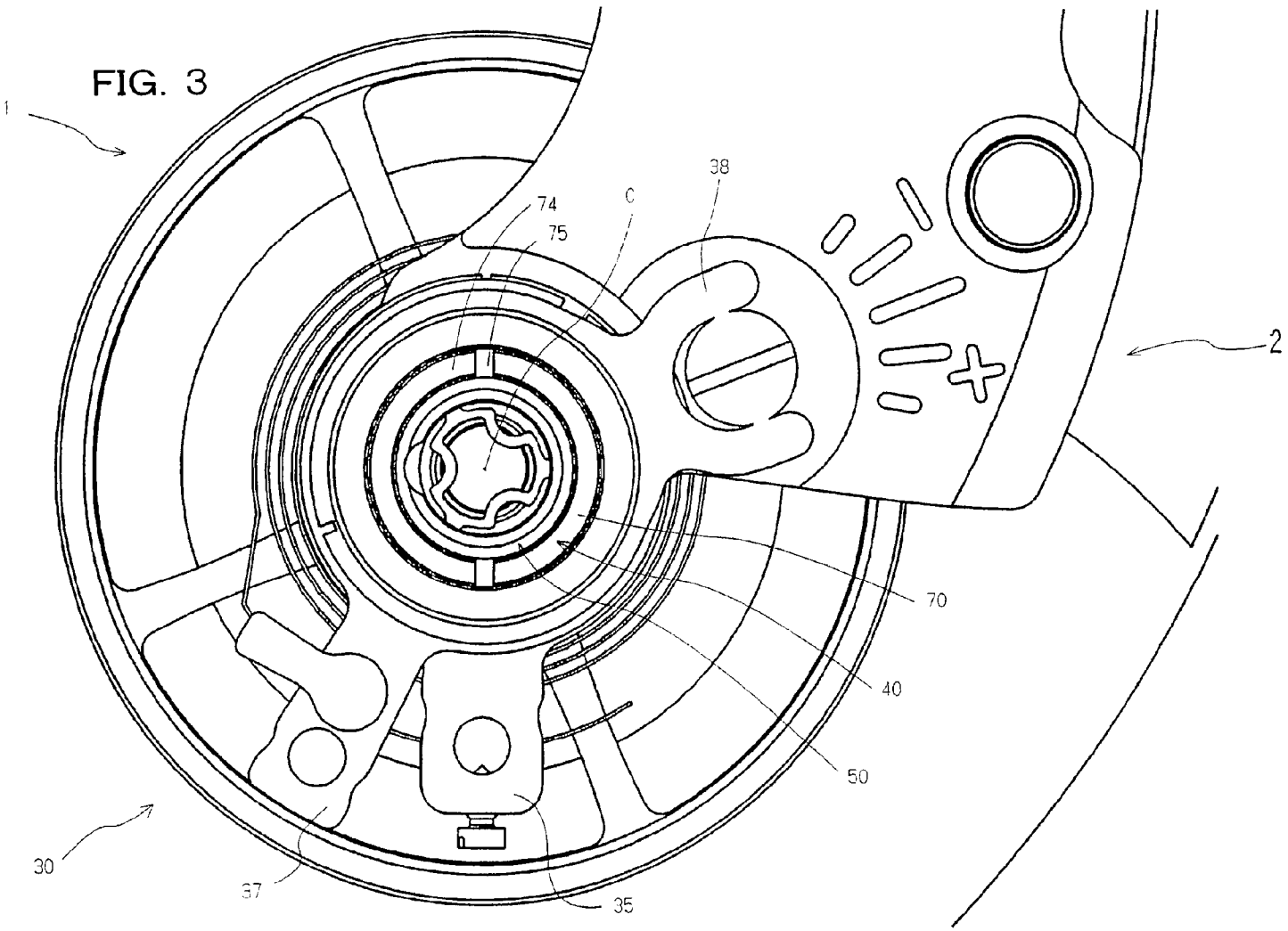
FIG. 3 is an explanatory plan view of the balance structure portion of the watch of FIG. 1.

FIGS. 1 through 3 partially show a watch 3 according to a preferred embodiment of the present invention having a balance structure 2 equipped with a balance upper bearing structure 1 as a bearing structure according to a preferred embodiment of the present invention. In the drawings, the case back side of the watch 3 is on the upper side as in the case of normal assembly and dismantling; in the following, the terms "upper side" and "lower side" mean the "upper side" and "lower side" as seen in the drawings.

The watch 3 is equipped with a main plate 7. The main plate 7 is equipped with a hole portion 7*a*, to which a balance lower bearing structure 10 is mounted. On the other hand, a balance bridge 20 as a base body is detachably fixed to a bridge stand 7*b* of the main plate 7. A balance upper bearing structure 1 is incorporated into the balance bridge 20.

The balance structure 2 is composed of a balance main body 30, the balance upper bearing structure 1, and a balance lower bearing structure 10.

As can be seen from FIGS. 2 and 3 as well as FIG. 1, the balance main body 30 as a wheel includes a balance staff 31 as a shaft, a balance wheel 32, a collet 33, a hairspring 34, a stud support 35, a double roller 36, etc.; further, it includes what the balance main body 30 should usually have such as a body of regulator 37 and a regulator pointer 38. Since the structure of the balance main body 30 and the functions of the parts thereof themselves are well known in the art, a detailed description thereof will be omitted here.

As can be seen from FIG. 1, the balance lower bearing structure 10 is of the same structure as in the prior art; it includes a lower outer bearing frame 11 fitted to the hole portion 7*a*, an inner bearing frame 12, a hole jewel 13, a lower cap jewel 14, and a cap jewel support fastener 15.

One end portion 20*a* of the balance bridge 20 is fixed to the bridge stand 7*b* of the main plate 7, and another end portion 20*b* thereof is equipped with a hole portion 21. More specifically, in an upper surface 20*c* (case back side surface) of the end portion 20*b*, the balance bridge 20 is equipped with an annular groove portion 22 around the hole portion 21, and is equipped with a cylindrical portion 23 defining the inner peripheral side of the annular groove portion 22 and an annular flange-like portion 24 protruding radially inwards from a central portion 23*b* of an inner peripheral surface 23*a* of the cylindrical portion 23, with the hole portion 21 being defined by an inner peripheral surface 24*a* of the annular flange-like portion 24.

The balance upper bearing structure 1 rotatably supporting the balance staff 31 of the balance main body 30 at the upper end portion or an upper tenon portion 31*a* thereof with respect to the balance bridge 20, has a bearing support body 40, a bearing 50, an elastic member 6, and an adjustment nut 70.

Here, the bearing 50 includes an upper hole jewel 51 and an upper cap jewel 52, and an inner bearing frame 53 supporting the upper hole jewel 51 and the upper cap jewel 52, and the bearing support body 40 as a bearing frame includes an upper outer bearing frame 41 and a cap jewel support fastener 42. In the bearing 50, the cap jewel support fastener 42 is locked to a lock portion 43 of the outer bearing frame 41, and the upper hole jewel 51, the upper cap jewel 52, and the inner bearing frame 53 are supported between the cap jewel support fastener 42 and the outer bearing frame 41, and the upper hole jewel 51 and the upper cap jewel 52 are supported between the cap jewel support fastener 42 and the inner bearing frame 53. Here, the inner bearing frame 53, the hole jewel 51, the cap jewel 52, and the cap jewel support fastener 42 that are on the upper side are respectively formed in constructions similar to those of the inner bearing frame 12, the hole jewel 13, the cap jewel 14, and the cap jewel support fastener 15 that are on the lower side. Further, in this area, the upper outer bearing frame 41 is formed in a construction similar to that of the lower outer bearing frame 11.

The upper outer bearing frame 41 has a cylindrical portion 44 constituting a main body, and the cylindrical portion 44, which is concentric with the balance staff 31, extends through the hole portion 21 so as to be movable in the extending directions A1, A2 of the center axis C of the balance staff 31. The outer bearing frame 41 has a male screw portion 45 on an outer peripheral surface 44*b* of a peripheral wall portion 44*a* situated on the upper side of mainly the flange-like portion 24 of the cylindrical portion 44, and a flange-like portion 46 extending radially outwards so as to face a surface 24*b* facing the balance wheel 32 of the flange-like portion 24 of the balance bridge 20 from the outer peripheral surface of the peripheral wall portion 44*c* situated on the lower side of the flange-like portion 24 (on the base portion side of the balance staff 31 or the side where the balance wheel 32 exists).

The elastic member 6 is arranged between a surface 24*b* of the flange-like portion 24 of the balance bridge 20 and an opposing surface 46*a* of the flange-like portion 46 of the outer bearing frame 41, and exerts a force causing the two surfaces 24*b*, 46*a* to be separated from each other, biasing the outer bearing frame 41 in the direction A1 with respect to the balance bridge 20. The elastic member 6 can effect positioning on the outer bearing frame 41 without involving any rattling; further, when an impact is applied to the balance structure 2, it mitigates the impact, making it possible to suppress an excessive force from being applied to the tenon portion 31*a* of the balance staff 31, etc. The elastic member 6 consists, for example, of a belleville spring. However, it is also possible to employ some other type of component as long as it is arranged between the annular surfaces 24*b*, 46*a* and can exert a force causing the two surfaces 24*b*, 46*a* to be separated from each other.

The adjustment nut 70 is equipped with a female screw portion 71 threadedly engaged with a male screw portion 45 of the outer bearing frame 41. Under the action of the elastic member 6, one end surface 72 of the adjustment nut 70 abuts the surface of the flange-like portion 24 of the balance bridge 20 which is on the opposite side of the surface 24*b*, that is, the upper surface 24*c*, and is regulated or set in its displacement in the direction A1 by the flange-like portion 24.

Thus, when the adjustment nut 70 is rotated clockwise around the center axis C, that is, in the direction C1, the outer bearing frame 41 is displaced in the direction A2. On the other hand, when the adjustment nut 70 is rotated counterclockwise, that is, in the direction C2, around the center axis C, the outer bearing frame 41 is displaced in the direction A1. That is, in accordance with rotation in the directions C1, C2 of the adjustment nut 70, the outer bearing frame 41 is displaced in the directions A2, A1 with respect to the balance bridge 20, and the position of the bearing 50 with respect to the direction in which the axis C extends can be adjusted.

A driver groove 75 is formed diametrically in the upper end surface 74 of the adjustment nut 70. Thus, in the balance upper bearing structure 1, in the state in which the balance upper bearing structure 1 has been assembled to the watch 3, the forward end portion of a flatblade screwdriver is engaged with the groove 75, and, solely by rotating the shaft of the screwdriver clockwise or counterclockwise, the rotating position of the adjustment nut 70 is adjusted, and the position of the bearing 50 itself with respect to the extending directions A1, A2 of the axis C can be adjusted. Thus, the requisite space for the adjustment can be minimized. Further, through the adjustment of the position of the bearing 50 in the directions A1, A2, the distance between the bearing 50 and the lower bearing structure 10 can be adjusted to an appropriate magnitude that is neither too large nor too small, so that the balance staff 31 of the balance main body 30 of the balance structure 2 can be reciprocated in the directions C1, C2 at a predetermined frequency as designed, whereby it is possible to effect a predetermined time measurement.

The engaged portion of the adjustment nut 70 which is engaged with the turning tool to receive rotational torque may consist of some other structure than the groove 75 that diametrically extends across the annular end surface 74.

Next, a watch 3A according to another preferred embodiment of the present invention having a balance structure 2A according to another preferred embodiment of the present invention will be described with reference to FIG. 4.

Figure 4:
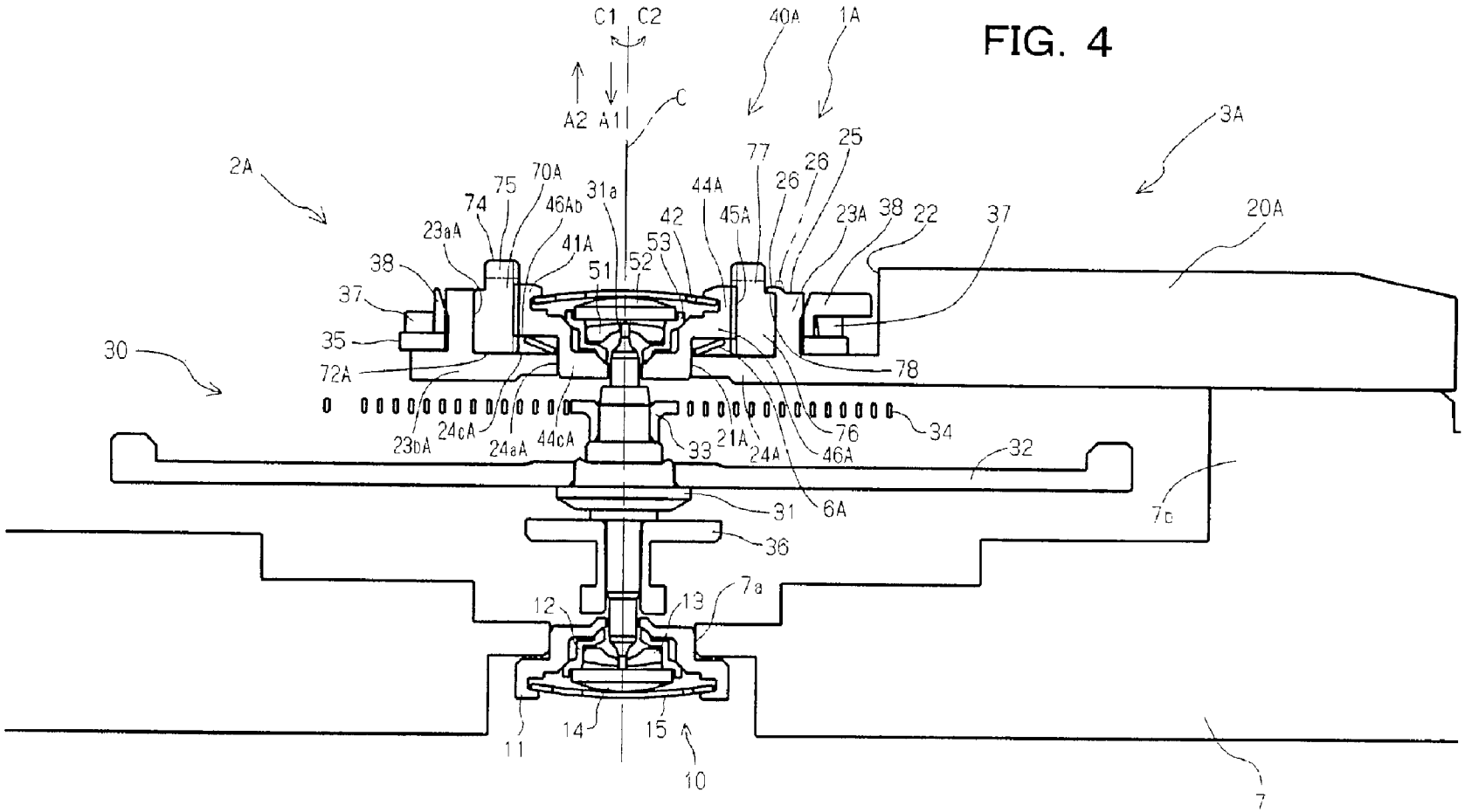
FIG. 4 is an explanatory sectional view of a part of a watch according to a preferred another embodiment of the present invention having a balance structure according to another preferred embodiment of the present invention.

In the balance structure 2A of the watch 3A of FIG. 4, the elements, portions, etc. that are the same as the elements, portions, etc. of the balance structure 2 shown in FIGS. 1 through 3 are indicated by the same reference numerals, and the elements, portions, etc. that are corresponding to but somewhat different from the elements, portions, etc. of the balance structure 2 shown in FIGS. 1 through 3 are indicated by the same reference numerals with symbol A affixed thereto.

In the balance structure 2A, a cylindrical portion 23A of a balance bridge 20A is equipped with a flange-like portion 24A extending radially inwards from a lower end portion 23*b*A of an inner peripheral surface 23*a*A thereof, and an inner peripheral end 24*a*A of the annular flange-like portion 24A defines a hole portion 21A. The cylindrical portion 23A has a swaged portion 26 extending from an upper end portion 25 thereof.

Further, in the balance upper bearing structure 1A of the balance structure 2A, an outer bearing frame 41A has a small diameter lower peripheral wall portion 44*c*A and a large diameter cylindrical portion 44A situated on the upper side of a lower peripheral wall portion 44*c*A (the forward end 31*a* side of the balance staff 31). The small diameter lower peripheral wall portion 44*c* of the outer bearing frame 41A is movably fit-engaged with a hole portion 21A of the balance bridge 20A. Between the small diameter lower peripheral wall portion 44*c*A and the large diameter cylindrical portion 44A, there is formed a flange-like portion 46A protruding radially outwards and equipped with a surface 46A*b* facing a peripheral wall portion of the hole portion 21A, that is, an upper surface 24*c*A of the flange-like portion 24A. The cylindrical portion 44A has a male screw portion 45A on an outer peripheral surface, which is concentric with the balance staff 31. In this example, the bearing support body 40A is composed of the outer bearing frame 41A and the cap jewel support fastener 42.

Further, in the balance upper bearing structure 1A of the balance structure 2A, an elastic member 6A in the form of a belleville spring is arranged between an upper surface 24*c*A of the flange-like portion 24A of the balance bridge 20A and a lower surface 46A*b* of the flange-like portion 46A of the outer bearing frame 41A opposed thereto in order to exert a force causing the two surfaces 24*c*A, 46A*b* to separate from each other.

Further, in the balance upper bearing structure 1A of the balance structure 2A, an adjustment nut 70A is equipped with a large diameter portion 76 and a small diameter portion 77. A swaged portion 26 as a protrusion protruding radially inwards from the upper end portion 25 of the cylindrical portion 23A of the balance bridge 20A, is bent radially inwards by swaging, and is engaged with a step portion 78 of the large diameter portion 76 and the small diameter portion 77 of the adjustment nut 70A. Thus, the movement of the adjustment nut 70A in the direction A2 with respect to the balance bridge 20A is regulated or set by the swaged portion 26 engaged with the step portion 78. A lower surface 72A of the adjustment nut 70A abuts an upper surface 24*c*A of the flange-like portion 24A of the balance bridge 20A, and the displacement of the adjustment nut 70A in the direction A1 with respect to the balance bridge 20A is regulated or set by the flange-like portion 24A.

Also in the balance structure 2A, a turning tool such as a screwdriver is engaged with the driver groove 75 in the upper end surface 74 of the adjustment nut 70A, and, solely by turning the adjustment nut 70A in the direction C1 or C2, the outer bearing frame 41A is displaced in the direction A2 or A1 with respect to the balance bridge 20A to thereby adjust the position in the directions A1, A2 of the balance upper bearing structure 1A, whereby it is possible to realize a condition suitable for reciprocal rotation of the balance staff 31 of the balance structure 2A.

Next, a watch 3B according to still another preferred embodiment of the present invention having an escape wheel & pinion structure 2B according to still another preferred embodiment of the present invention will be described with reference to FIGS. 5 and 6.

Figure 5:
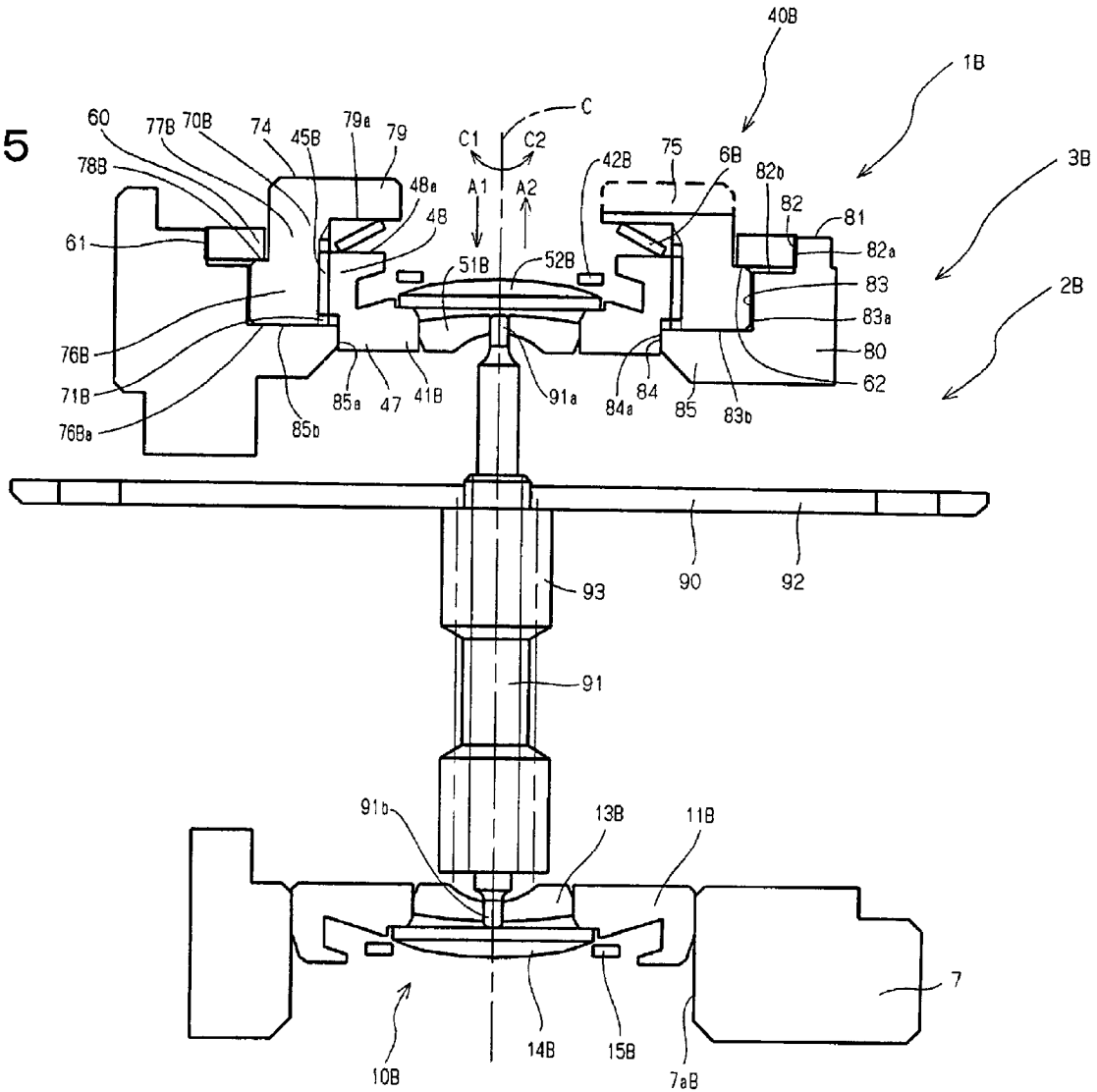
FIG. 5 is an explanatory sectional view of a part of a watch according to still another preferred embodiment of the present invention having an escape wheel & pinion structure according to still another preferred embodiment of the present invention.
Figure 6:
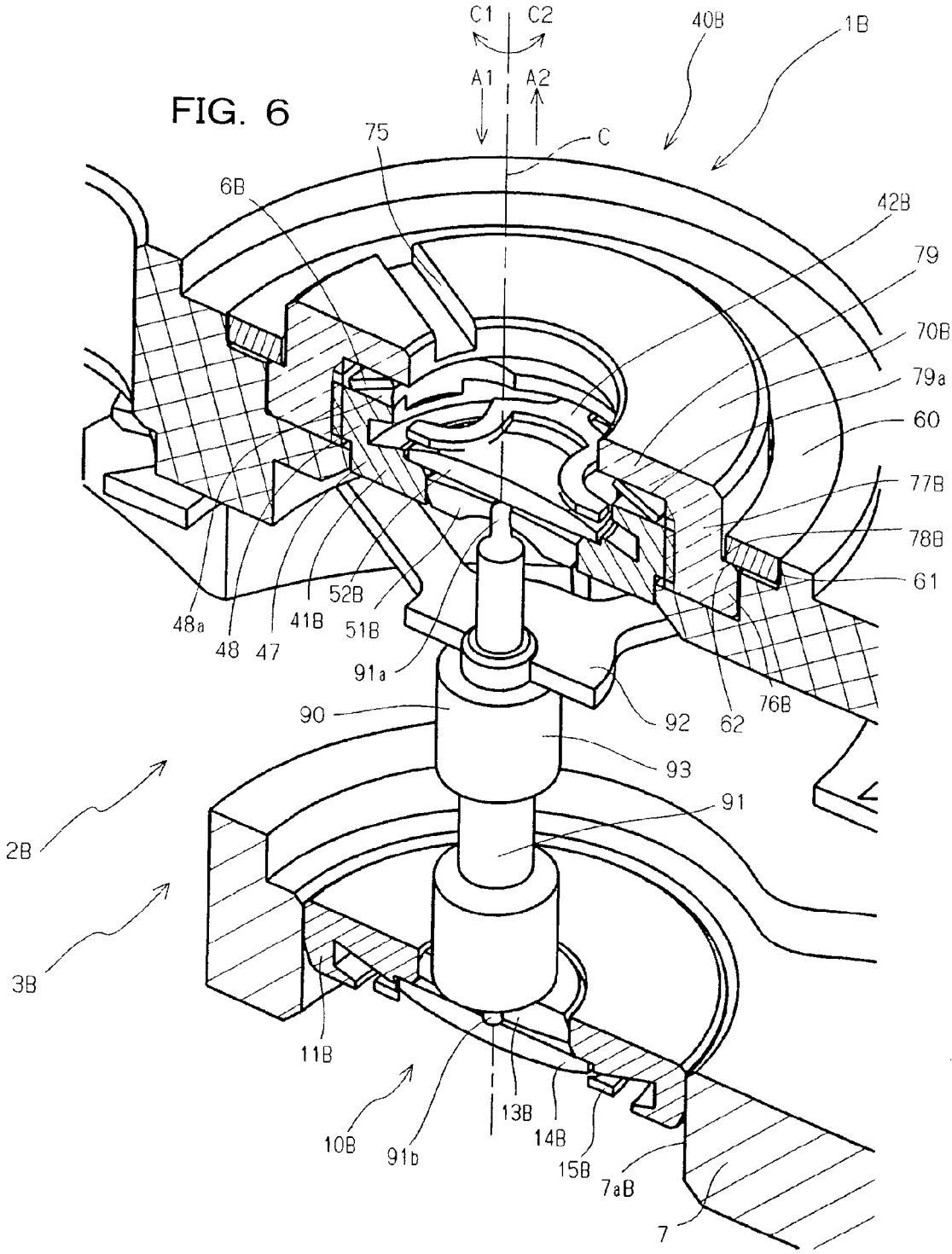
FIG. 6 is a partially cutaway explanatory perspective view of a part of the watch of FIG. 5 including the escape wheel & pinion structure of FIG. 5.

In the escape wheel & pinion structure 2B of the watch 3B of FIGS. 5 and 6, the elements, portions, etc. that are the same as the elements, portions, etc. of the balance structure 2 shown in FIGS. 1 through 3 are indicated by the same reference numerals, and the elements, portions, etc. corresponding to, though somewhat different from, the elements, portions, etc. of the balance structure 2 shown in FIGS. 1 through 3 and of the balance structure 2A shown in FIG. 4 are indicated by the same reference numerals with a symbol B affixed thereto (with symbol A omitted where symbol A is affixed to the reference numerals).

In the escape wheel & pinion structure 2B, an escape wheel & pinion main body 90 is supported by a lower bearing structure 10B and an upper bearing structure 1B so as to be rotatable in the directions C1, C2 around the center axis C. In an outer bearing frame 11B, the lower bearing structure 10B is fitted into a hole 7*a*B of the main plate 7, and the upper bearing structure 1B is attached to a train wheel bridge 80.

The escape wheel & pinion main body 90 has an escape wheel shaft or escape wheel arbor 91, an escape wheel 92 integral with the escape wheel shaft 91, and an escape pinion 93. The escape shaft 91 has at both end portions thereof thin shaft portions or tenon portions 91*a*, 91*b* rotatably supported by the upper bearing structure 1B and the lower bearing structure 10B. The escape wheel 92 is engaged with a body of pallet fork (not shown), and the escape pinion 93 is held in mesh with a wheel constituting a time measurement train wheel (not shown) of the watch 1B to support the time measurement operation of the watch 1B, which is well known in itself, so a description thereof will be omitted.

In the escape wheel & pinion structure 2B, the train wheel bridge 80 has on the inner side of the upper surface 81 thereof an annular large diameter recess 82, an annular small diameter recess 83, and an circular hole portion 84, which are concentric. Here, the large diameter recess 82 is defined by a cylindrical peripheral surface 82*a* and an annular bottom surface 82*b*, whose center is the center axis C, and the small diameter recess 83 is defined by a cylindrical peripheral surface 83*a* and an annular bottom surface 83*b*, whose center is the center axis C. The cylindrical peripheral surface 83*a* is continuous with the inner peripheral edge of the annular bottom surface 82*b*. The circular hole portion 84 is defined by a cylindrical peripheral surface 84*a*, and the cylindrical peripheral surface 84*a* is continuous with the annular bottom surface 83*b* of the small diameter recess 83. Thus, the train wheel bridge 80 is equipped with an annular flange-like portion 85, and an inner peripheral surface 85*a* of the flange-like portion 85 is defined by the peripheral surface 84*a* of the hole portion 84, with one surface 85*b* of the flange-like portion 85 being defined by the bottom surface 83*b* of the small diameter recess 83.

Further, in the escape wheel & pinion upper bearing structure 1B of the escape wheel & pinion structure 2B, a bearing frame 41B has a small diameter peripheral wall portion 47 and a large diameter cylindrical portion 48 situated on the upper side of the small diameter peripheral wall portion 47 (on the side of a tenon portion 91*a* at the forward end of the escape wheel shaft 91). The small diameter peripheral wall portion 47 of the bearing frame 41B is movably fit-engaged with the hole portion 84 of the train wheel 80. The large diameter cylindrical portion 48 has a male screw portion 45B on an outer peripheral surface that is concentric with the escape wheel shaft 91. In this example, the bearing support body 40B is composed of the bearing frame 41B and a cap jewel support fastener 42B.

The male screw portion 45B is threadedly engaged with an adjustment nut 70B equipped with a female screw portion 71B. The adjustment nut 70B is equipped with a large diameter portion 76B and a small diameter portion 77B, and the large diameter portion 76B is rotatably fit-engaged with the small diameter recess 83 of the train wheel bridge 80. The height of the large diameter portion 76B is approximately the same as the depth of the small diameter recess 83, and is typically somewhat larger than the depth. Thus, the step portion 78B of the large diameter portion 76B and the small diameter portion 77B is approximately the same height as the bottom surface 82*b* of the large diameter recess 82, and typically protrudes slightly beyond the bottom surface 82*b*. Further, the adjustment nut 70B has at the top portion of the small diameter portion 77B an annular flange-like portion 79 extending radially inwards, and a lower surface 79*a* of the flange-like portion 79 faces a top surface 48*a* of the large diameter cylindrical portion 48 of the bearing frame 41B. A lower surface 76B*a* of the large diameter portion 76B of the adjustment nut 70B abuts the bottom surface 83*b* of the small diameter recess 83 of the train wheel bridge 80, and displacement of the adjustment nut 70B in the direction A1 is prohibited or set by the train wheel bridge 80.

An annular holding ring 60 is fitted to the large diameter recess 82 of the train wheel bridge 80. That is, the holding ring 60 is driven into the large diameter recess 82 of the train wheel bridge 80, and an outer peripheral surface 61 of the holding ring 60 is held in intimate contact with a peripheral surface 82*a* of the large diameter recess 82 of the train wheel bridge 80. Further, a lower surface 62 of the holding ring 60 is in contact with the step portion 78B of the adjustment nut 70B to actually prohibit or set displacement of the adjustment nut 70B in the direction A2.

Between the lower surface 79*a* of the flange-like portion 79 of the adjustment nut 70B and the top surface 48*a* of the large diameter cylindrical portion 48 of the bearing frame 41, there is arranged a belleville spring 6B as an elastic member, and the belleville spring 6B exerts a force causing the surfaces 79*a*, 48*a* to separate from each other.

Also in the escape wheel & pinion structure 2B, a turning tool such as a screwdriver is engaged with the driver groove 75 in the upper end surface 74 of the adjustment nut 70B, and, solely by turning the adjustment nut 70B in the direction C1 or C2, the bearing frame 41B is displaced in the direction A2 or A1 with respect to the train wheel bridge 80 to adjust the position of the escape wheel & pinion upper bearing structure 1B in the directions A1, A2, whereby it is possible to realize a condition suitable for reciprocating rotation of the escape wheel arbor or escape wheel shaft 91 of the escape wheel & pinion structure 2B.

What is claimed is:

1. A bearing structure rotatably supporting a forward end portion of a wheel shaft with respect to a base body, comprising:

a bearing, a bearing support body supporting the bearing and having a male screw portion on an outer peripheral surface concentric with the wheel shaft, and an adjustment nut equipped with a female screw portion threadedly engaged with the male screw portion of the bearing support body, regulated in displacement in the extending direction of the wheel shaft by the base body, and adapted to adjust the position of the bearing with respect to the extending direction of the shaft via the bearing support body, through rotation of the adjustment nut relative to the base body.

2. A bearing structure according to claim 1, wherein the bearing support body is fit-engaged with a hole portion of the base body; the bearing support body is equipped with a flange-like portion protruding radially outwards in a region situated on the wheel shaft base portion side of the hole portion of the base body and facing one end surface of a peripheral wall of the hole portion of the base body;

between the one end surface of the peripheral wall of the hole portion of the base body and the opposing surface of the flange-like portion of the bearing support body, there is arranged an elastic member exerting a force causing the two surfaces to separate from each other; and one end surface of the adjustment nut is in contact with the end surface of the end surfaces of the peripheral wall of the hole portion of the base body which is on the opposite side of the one end surface.

3. A bearing structure according to claim 2, wherein the adjustment nut has a driver groove in the end surface thereof.

4. A bearing structure according to claim 2, wherein the bearing has a bearing cap jewel and a bearing hole jewel.

5. A bearing structure according to claim 1, wherein the bearing support body is fit-engaged with a hole portion of the base body; the bearing support body is equipped with a flange-like portion protruding radially outwards in a region situated on the wheel shaft forward end portion side of the hole portion of the base body and facing one end surface of a peripheral wall of the hole portion of the base body;

between the one end surface of the peripheral wall of the hole portion of the base body and the opposing surface of the flange-like portion of the bearing support body, there is arranged an elastic member exerting a force causing the two surfaces to separate from each other;

one end surface of the adjustment nut is in contact with the one end surface of the peripheral wall of the hole portion of the base body; and displacement of the adjustment nut toward the forward end of the shaft is regulated.

6. A bearing structure according to claim 5, wherein the adjustment nut is equipped with a large diameter portion and a small diameter portion, and a protrusion protruding radially inwards from the base body is engaged with a step portion of the large diameter portion and the small diameter portion of the adjustment nut, thereby effecting the regulation.

7. A bearing structure according to claim 6, wherein the adjustment nut has a driver groove in the end surface thereof.

8. A bearing structure according to claim 6, wherein the bearing has a bearing cap jewel and a bearing hole jewel.

9. A bearing structure according to claim 5, wherein the adjustment nut has a driver groove in the end surface thereof.

10. A bearing structure according to claim 5, wherein the bearing has a bearing cap jewel and a bearing hole jewel.

11. A bearing structure according to claim 1, wherein the bearing support body is fit-engaged with a hole portion of the base body; the adjustment nut is equipped with a flange-like portion extending radially inwards;

between the nut side end surface of the bearing support body facing the flange-like portion of the adjustment nut and the surface of the flange-like portion facing the nut side end surface, there is arranged an elastic member exerting a force causing the two surfaces to separate from each other; and the adjustment nut is regulated in its displacement in the extending direction of the shaft by the flange-like portion of the base body and a holding ring fitted onto the base body.

12. A bearing structure according to claim 11, wherein the adjustment nut has a driver groove in the end surface thereof.

13. A bearing structure according to claim 11, wherein the bearing has a bearing cap jewel and a bearing hole jewel.

14. A bearing structure according to claim 1, wherein the adjustment nut has a driver groove in the end surface thereof.

15. A bearing structure according to claim 14, wherein the bearing has a bearing cap jewel and a bearing hole jewel.

16. A bearing structure according to claim 1, wherein the bearing has a bearing cap jewel and a bearing hole jewel.

17. A bearing structure according to claim 1, wherein the wheel consists of a watch component.

18. A bearing structure according to claim 17, wherein the wheel consists of a balance with hairspring or an escape wheel & pinion of a watch.

19. A watch which is equipped with a bearing structure as claimed in claim 1.

* * * * *